US009177749B2

(12) United States Patent
Reynolds et al.

(10) Patent No.: US 9,177,749 B2
(45) Date of Patent: Nov. 3, 2015

(54) MAGNETRON CATHODES

(71) Applicant: E2V Technologies Limited, Chelmsford, Essex (GB)

(72) Inventors: Clive Reynolds, Chelmsford (GB); Robert Charles Lodge, Chelmsford (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 200 days.

(21) Appl. No.: 14/025,918

(22) Filed: Sep. 13, 2013

(65) Prior Publication Data

US 2014/0210340 A1 Jul. 31, 2014

(30) Foreign Application Priority Data

Sep. 13, 2012 (GB) ..... 1216368.9

(51) Int. Cl.
*H01J 23/05* (2006.01)
*H01J 25/587* (2006.01)
*H01J 25/50* (2006.01)

(52) U.S. Cl.
CPC ..... *H01J 23/05* (2013.01); *H01J 25/50* (2013.01); *H01J 25/587* (2013.01)

(58) Field of Classification Search
None
See application file for complete search history.

(56) References Cited

U.S. PATENT DOCUMENTS 3,308,329 A * 3/1967 Smith et al. ..... 313/107
3,614,440 A * 10/1971 Carr ..... 250/423 R
3,786,258 A * 1/1974 Schmidt ..... 376/115
3,914,644 A * 10/1975 Gerard ..... 315/39.61
4,096,541 A * 6/1978 Bohin et al. ..... 361/120
4,223,246 A * 9/1980 Osepchuk ..... 315/39.71
4,380,717 A * 4/1983 Pickering ..... 315/39.51
4,455,504 A * 6/1984 Iversen ..... 313/30
4,743,805 A * 5/1988 Takada ..... 315/39.75
4,900,985 A * 2/1990 Tashiro et al. ..... 315/39.51
5,177,403 A * 1/1993 Kawaguchi et al. ..... 315/39.71
5,215,703 A * 6/1993 Bernardet ..... 376/114
5,293,410 A * 3/1994 Chen et al. ..... 376/108
5,745,537 A * 4/1998 Verschoore ..... 376/114
8,264,150 B2 * 9/2012 Leonhardt ..... 315/39.51
8,928,223 B2 * 1/2015 Higashi ..... 315/39.51
9,000,669 B2 * 4/2015 Kuwahara et al. ..... 315/39.51

OTHER PUBLICATIONS

UK Search Report, Application No. GB 1316363.9 dated Feb. 5, 2014.

* cited by examiner

*Primary Examiner* — Tung X Le
*Assistant Examiner* — Srinivas Sathiraju
(74) *Attorney, Agent, or Firm* — Venable LLP; Robert Kinberg

(57) ABSTRACT

A magnetron cathode comprises electron emissive material included in a cathode body and a support structure for supporting the cathode body. The support structure has a longitudinal axis and includes a first part having a first cylinder integrally formed with a first end hat and a second part having a second cylinder integrally formed with a second end hat. The first cylinder and the second cylinder have an overlapping region in the longitudinal axial direction and are joined together. The cathode body is located around the first cylinder of the first part of the support structure and is joined to the first cylinder by a brazed joint. The outer surface of the first cylinder is grooved at the brazed joint.

19 Claims, 2 Drawing Sheets

MAGNETRON CATHODES

CROSS-REFERENCE TO RELATED APPLICATION

This application claims the priority of Great Britain Patent Application GB 1216368.9, filed on Sep. 13, 2012, the subject matter of which is incorporated herein by reference.

FIELD OF THE INVENTION

This invention relates to magnetron cathodes and to magnetrons including such cathodes.

BACKGROUND

Magnetrons are devices for generating high frequency power. In one type of magnetron, a cathode is surrounded by an anode in a generally coaxial arrangement. The anode includes resonant anode cavities which may, for example, be defined by a plurality of radially extending anode vanes or by some other configuration and the space between the cathode surface and the anode vane tips provides an interaction space. In operation, an electrical field is established between the anode and the cathode and a magnetic field is provided transverse to the electric field. Electrons emitted from the cathode are acted on by the electric and magnetic fields. Resonances build up in the anode cavities to produce a high frequency energy which is extracted from the anode space by a suitable coupling mechanism.

One known magnetron is schematically illustrated in longitudinal cross-section in FIG. 1. The magnetron includes a generally annular cavity 1 which coaxially surrounds a cathode 2 arranged along its longitudinal axis. An anode 3 comprises eight vanes 4 and the wall 5 of the cavity 1. Two magnetic pole pieces 6 and 7 are arranged at opposite ends the cathode 2 and are designed to produce a substantially axial field in the interaction region of the magnetron. A U-shaped piece 8 provides a return path for the magnetic flux. Sets of anode straps 9 are included to connect alternate ones of the vanes 4 to control the mode of resonance of the magnetron.

BRIEF SUMMARY

According to a first aspect of the invention, a magnetron cathode comprises a cylindrical cathode body which includes electron emissive material and a support structure arranged to support the cathode body. The support structure has a longitudinal axis and includes a first part having a first cylinder integrally formed with a first end hat and a second part having a second cylinder integrally formed with a second end hat. The first cylinder and the second cylinder have an overlapping region in the longitudinal axial direction and are joined together, the cathode body being located around the first cylinder of the first part of the support structure and being joined to the first cylinder by a brazed joint. The outer surface of the first cylinder is grooved at the brazed joint.

A magnetron cathode in accordance with the invention may have a construction which is structurally robust and relatively rigid. This is a particular advantage in, for example, X-ray radiotherapy applications, where movement caused by mechanical stresses may cause output to vary and result in undesirable dose variations. A robust and relatively rigid structure aids in countering these unwanted effects. A magnetron cathode in accordance with the invention may be advantageously used in X-ray tomography, or other applications involving movement of the source, to provide a consistent output even when rotational stresses, for example, are involved. Relative movement between components of a magnetron may result in shifts in output frequency and other undesirable results. A magnetron cathode having a support structure in accordance with the invention may mitigate such problems. It may also provide a more lightweight magnetron cathode compared to a magnetron cathode of a conventional construction because of the additional rigidity afforded by the inventive approach. Embodiments in accordance with the invention may be beneficial in other applications also.

In addition, the construction of a magnetron cathode in accordance with the invention tends to facilitate manufacturing of magnetron cathodes because the integral nature of the end hat and cylinder parts and the overlapping region may provide self-jigging during assembly, resulting in more accurate final dimensions and repeatability and thus impacting on the quality of the cathode. Also, the integral nature of the end hat and cylinder parts provides a fixed relationship between those parts whatever movement is required of the cathode during operation, for example, which is desirable for consistent output of the magnetron. This may also be useful during shipping to reduce risk of distortion or movement of the cathode during handling or shipping, this again being beneficial for operation of the magnetron.

End hats, sometimes termed end pieces, are used to help confine electrons in the space between the anode and cathode of the magnetron. Embodiments may include end hat parts that are configured with curved surfaces or with flat surfaces.

The grooved outer surface of the first cylinder of the first part of the support structure may contain braze material prior to assembly. Following heating to make the brazed joint with the cathode body, during operation of the magnetron thereafter, the grooved outer surface may aid in maintaining structural integrity by providing keying of the brazed components as some of the braze material may remain in the groove or grooves. Additionally, the configuration of the grooves may be chosen to provide a relatively uniform distribution of braze material during manufacture, which may be advantageous, for example, as it tends to allow accurate positioning of the magnetron electron emissive regions.

In one embodiment, a plurality of circumferential grooves is included in the outer surface of the support structure cylinder at the brazed joint with the cathode body. Each or some of the grooves may be continuous. If some or all of the grooves are discontinuous, the grooves may be aligned such that the discontinuities in adjacent grooves are located at different locations at the circumference to give a staggered configuration.

In one embodiment, the outer surface of the first cylinder includes at least one helical groove at the brazed joint with the cathode body. This provides a longitudinally and circumferentially distributed source of braze material during the assembly process and also may provide mechanical support in longitudinal and circumferential directions.

In one embodiment, a combination of intersecting helical and circumferential grooves is used. Other groove configurations may be used in other embodiments.

The profile of the grooves may be V-shape, U-shape or a combination of V- and U-shape grooves at different parts of the grooved region. Other profiles or combinations of profiles may be used, for example, the profile could be a three-sided channel with flat walls at right angles to one another.

In one embodiment, the overlapping region of the first and second cylinders is located nearer to one end of the support structure in a longitudinal axial direction than to the centre of the support structure. In another embodiment, the overlapping region is centrally located and in another embodiment it is extensive along substantially the entire lengths of the first and second cylinders. The latter construction provides good strength and rigidity but requires more material and may be heavier, which is undesirable for some applications.

In one embodiment, the first cylinder is of longer axial extent than the second cylinder and the first cylinder is located inside the second cylinder in the overlapping region.

In one embodiment, the first part and the second part are joined by a brazed joint. Other types of joint may be used, for example, a cold weld joint.

In one embodiment, the first part and the second part are joined by a friction joint. This may provide a robust structure, for example, by ensuring that the first and second parts have appropriate dimensions for a secure join and/or that the overlapping region is sufficiently long and/or that the first and second parts are fixed in position by other components of the magnetron cathode or magnetron in which the cathode is included. A friction joint may reduce the number of manufacturing and assembly steps required.

In one embodiment, the outer surface of the support structure has a larger diameter at least one end of the support structure than a smaller diameter between the ends of the support structure and the cathode body is located at the smaller diameter. The cathode body may be located over the entire region of smaller diameter or over a selected area of it.

In one embodiment the first cylinder has a step between the larger diameter and the smaller diameter and the step is adjacent to the cathode body. The step may be used to position the cathode body in the desired location which is useful during assembly and may also aid in securing the cathode body during operation of the magnetron in which the cathode is included. The electron emissive material included in the cathode body may generate electrons by thermionic emission, secondary electron emission, semiconductor processes or some other appropriate mechanism or combination of mechanisms.

In one embodiment the cathode body is a dispenser cathode body. In another embodiment, the cathode body is an oxide cathode. In an oxide cathode, semiconductor-type mechanisms provide electrons from the electron emissive material. The oxide cathode may be of nickel or some other suitable material as a matrix which contains the emissive material.

In one embodiment, at least one of the first and second parts is of refractory material. The first part may be of the same material as the second part or they may be of different materials.

In one embodiment, at least one of the first and second parts is of molybdenum and includes carburized molybdenum over at least some of the surface of said at least one of the first and second parts. This may reduce generation of spurious electrons from the surface which might otherwise interfere with the desired operation of the magnetron.

In one embodiment, where an end hat is curved, at least some of the curved surface is of carburized molybdenum.

In one embodiment, a heater coil is located inside the support structure and in physical contact with it. The relatively rigid construction of the support structure allows good thermal contact to be maintained and also holds the heater coil in position in a robust manner. Heating may be provided via conduction or by a combination of conduction and radiation, say. In another embodiment, the heater coil is spaced from the support structure and radiation is the main mechanism for transferring thermal energy to the electron emissive material.

In one embodiment, a heater is potted in insulating material.

According to a second aspect of the invention, a magnetron comprises a magnetron cathode in accordance with the first aspect of the invention and an anode structure arranged coaxially with the magnetron cathode.

BRIEF DESCRIPTION OF THE DRAWINGS

Some embodiments of the present invention will now be described by of example only, and with reference to the accompanying drawings, in which.

DETAILED DESCRIPTION

Figure 1:
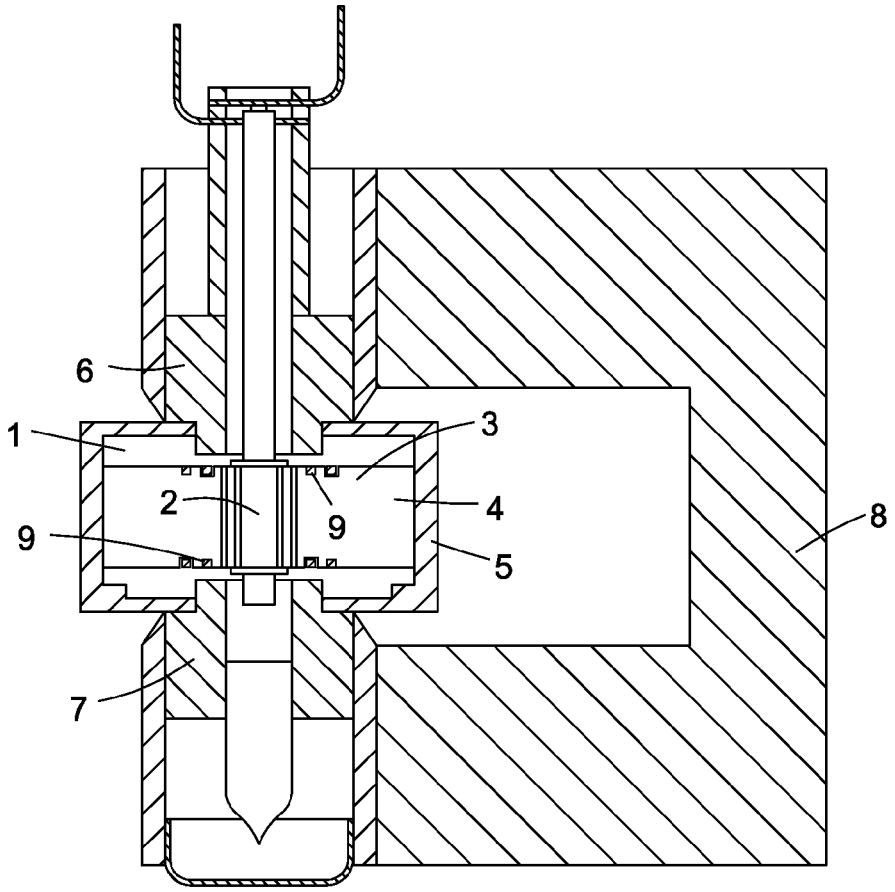
FIG. 1 schematically illustrates in longitudinal cross-section a previously known magnetron.
Figure 2:
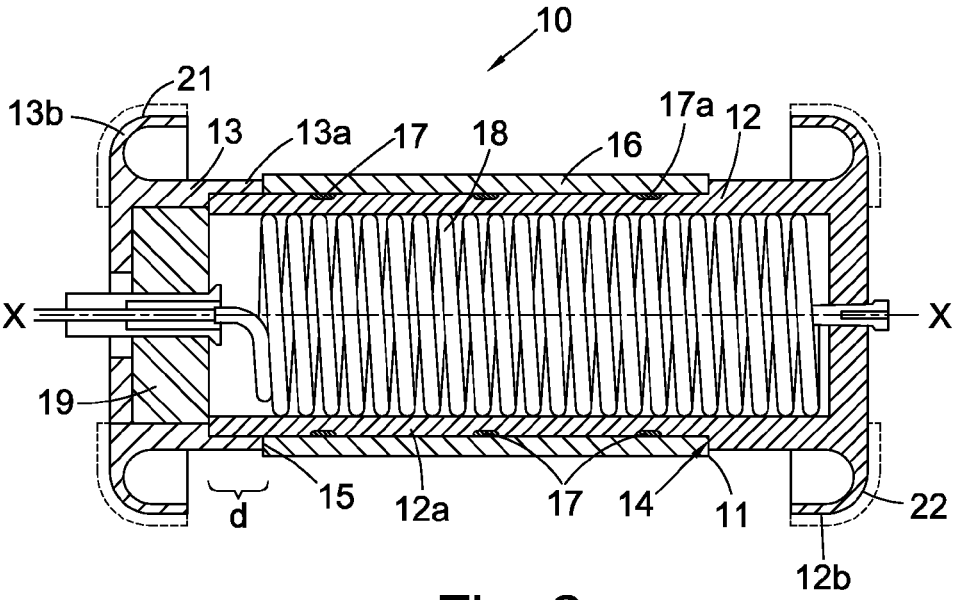
FIG. 2 schematically illustrates in longitudinal cross-section a magnetron cathode in accordance with the invention.

With reference to FIG. 2, a magnetron cathode 10 includes a support structure 11 having a longitudinal axis X-X and formed from a first part 12 and a second part 13. The first part 12 includes a first cylinder 12*a* integrally formed with a first end hat 12*b*. The second part 13 includes a second cylinder 13*a* integrally formed with a second end hat 13*b*. The first cylinder 12*a* is of greater longitudinal extent than the second cylinder 13*a* and has an external diameter that is smaller than the internal diameter of the second cylinder 13*a*. The two cylinders 12*a* and 13*a* overlap in the longitudinal direction by an amount d and are brazed together. The dimensions and braze material provide a secure joint between the first and second cylinders 12*a* and 13*a*.

The first cylinder 12*a* has a larger external diameter nearer the first end hat 13*a* to provide a step 14. The end of the second cylinder defines another step 15 which is of the same height in the radial direction as the first step 14. A dispenser cathode body 16 includes electron emissive material contained in a tungsten supporting matrix and is configured as a cylinder located around the outer surface of the support structure 11, being located between and abutting the steps 14 and 15. A plurality of circumferential grooves 17 in the outer surface of the support structure 11 hold braze material 17*a* prior to assembly which, when heated, flows between the inner surface of the dispenser cathode body 16 and the outer surface of the support structure 11 to form a joint which secures the dispenser cathode body 16 to the support structure 11. Some braze material 17*a* remains in the grooves 17 after assembly to provide additional joint strength.

In this embodiment, a heater 18 is located within the support structure 11 and is shown in FIG. 2 in non-sectional view for clarity. The heater 18 comprises an electrically conductive coil coated with electrically insulating material and is positioned in contact with the inner diameter of the support structure 11. During operation of a magnetron which includes the cathode of FIG. 2, current is passed through the coil to generate heat which reaches the emissive material via conduction and radiation to produce thermionic electrons emitted from the dispenser cathode body 16. The relatively rigid nature of the support structure, due to its construction, permits the coil to be firmly held against the inner surface of the support structure, thus providing good heat transfer characteristics. The end of the heater conductor passes through a ceramic end piece 19.

In another embodiment, the dispenser cathode body could be directly heated by passing current through it or it could be heated by radiation from a heater not in contact with the support structure.

The first and second end hats 12*b* and 13*b* are both curved in this embodiment. In other embodiments one or both may be non-curved such that they are substantially extensive in a direction normal to the longitudinal axis X-X, for example.

The first and second parts 12 and 13 are of molybdenum. The curved outer surfaces 21 and 22 of the end hats 12*b* and 13*b* are roughened and carburized as indicated by the broken lines. This tends to reduce unwanted electron emission from those regions which might otherwise lead to disturbances in the magnetron output.

Figure 3:
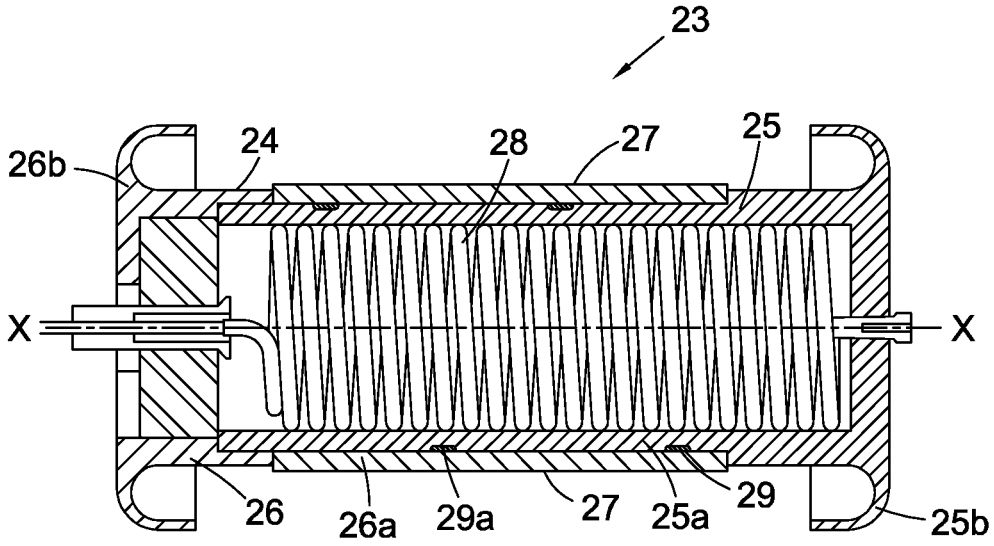
FIG. 3 schematically illustrates another magnetron cathode in accordance with the invention.

With reference to FIG. 3, another magnetron cathode 23 includes a support structure 24 having a longitudinal axis X-X and being formed from a first part 25 and a second part 26. The first part 25 includes a first cylinder 25*a* integrally formed with a first end hat 25*b*. The second part 26 includes a second cylinder 26*a* integrally formed with a second end hat 26*b*. The first cylinder 25*a* is of smaller diameter than the second cylinder 26*a* and is located within it. The first cylinder 25*a* and the second cylinder 26*a* are of similar longitudinal extent and overlap over most of the longitudinal distance between the end hats 25*b* and 26*b*. The cylinders 25*a* and 26*a* may be brazed together, have a friction joint between them or held in position by some other appropriate fashion.

In the embodiment of FIG. 3, an oxide cathode body 27 is supported by the support structure 24 and joined to it by a brazed joint. A heater 28 provides indirect conductive heating similar to that of the magnetron cathode shown in FIG. 2. In other embodiments, other heater arrangements as mentioned above may be used, for example. A helical groove 29 over in the outer surface of the support structure 24 includes some braze material 29*a* after assembly to provide additional joint strength.

Figure 4:
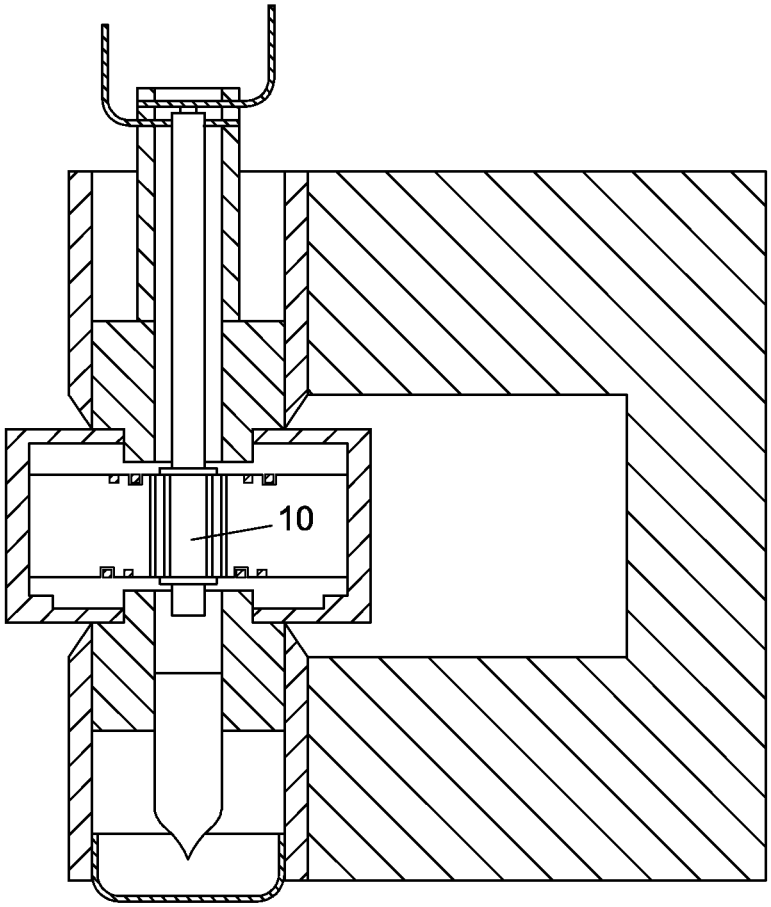
FIG. 4 schematically illustrates in longitudinal cross-section a magnetron comprising the cathode of FIG. 2.

FIG. 4 schematically shows a magnetron including the magnetron cathode 10 of FIG. 2. Another magnetron includes the magnetron cathode of FIG. 3.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A magnetron cathode comprising: a cylindrical cathode body which includes electron emissive material and a support structure arranged to support the cathode body, the support structure having a longitudinal axis and including a first part having a first cylinder integrally formed with a first end hat and a second part having a second cylinder integrally formed with a second end hat, the first cylinder and the second cylinder having an overlapping region in the longitudinal axial direction and being joined together, the cathode body being located around the first cylinder of the first part of the support structure and being joined to the first cylinder by a brazed joint and the outer surface of the first cylinder being grooved at the brazed joint.

2. The magnetron cathode as claimed in claim 1 wherein the outer surface of the first cylinder includes a plurality of circumferential grooves at the brazed joint and/or at least one helical groove at the brazed joint.

3. The magnetron cathode as claimed in claim 1 wherein the overlapping region is located nearer to one end of the support structure in a longitudinal axial direction than to the center of the support structure.

4. The magnetron cathode as claimed in claim 2 wherein the overlapping region is located nearer to one end of the support structure in a longitudinal axial direction than to the center of the support structure.

5. The magnetron cathode as claimed in claim 1 wherein the first cylinder is of longer axial extent than the second cylinder and the first cylinder is located inside the second cylinder in the overlapping region.

6. The magnetron cathode as claimed in claim 2 wherein the first cylinder is of longer axial extent than the second cylinder and the first cylinder is located inside the second cylinder in the overlapping region.

7. The magnetron cathode as claimed in claim 1 wherein the first part and the second part are joined by a friction joint.

8. The magnetron cathode as claimed in claim 1 wherein the first part and the second part are joined by a brazed joint.

9. The magnetron cathode as claimed in claim 1 wherein the outer surface of the support structure has a larger diameter at least one end of the support structure than a smaller diameter between the ends of the support structure and the cathode body is located at the smaller diameter.

10. The magnetron cathode as claimed in claim 9 wherein the outer surface of the first cylinder includes a plurality of circumferential grooves at the brazed joint and/or at least one helical groove at the brazed joint.

11. The magnetron cathode as claimed in claim 9 wherein the first cylinder has a step between the larger diameter and the smaller diameter and the step is adjacent to the cathode body.

12. The magnetron cathode as claimed in claim 1 wherein at least one of the first and second parts is of refractory material.

13. The magnetron cathode as claimed in claim 12 wherein at least one of the first and second parts is of molybdenum and including carburized molybdenum over at least some of the surface of said at least one of the first and second parts.

14. The magnetron cathode as claimed in claim 1, wherein at least one of the first end hat and the second end hat is curved and at least some of the curved surface is of carburized molybdenum.

15. The magnetron cathode as claimed in claim 1 and including a heater coil located inside the support structure and in physical contact with it.

16. The magnetron cathode of claim 1 wherein the cathode body is a dispenser cathode body.

17. The magnetron cathode as claimed in claim 16 wherein the outer surface of the first cylinder includes a plurality of circumferential grooves at the brazed joint and/or at least one helical groove at the brazed joint.

18. A magnetron comprising a magnetron cathode and an anode structure, said anode structure being arranged coaxially with the magnetron cathode, and said magnetron cathode comprising: a cylindrical cathode body which includes electron emissive material and a support structure arranged to support the cathode body, the support structure having a longitudinal axis and including a first part having a first cylinder integrally formed with a first end hat and a second part having a second cylinder integrally formed with a second end hat, the first cylinder and the second cylinder having an overlapping region in the longitudinal axial direction and being joined together, the cathode body being located around the first cylinder of the first part of the support structure and being joined to the first cylinder by a brazed joint and the outer surface of the first cylinder being grooved at the brazed joint.

19. The magnetron as claimed in claim 18 wherein the outer surface of the first cylinder includes a plurality of circumferential grooves at the brazed joint and/or at least one helical groove at the brazed joint.

* * * * *